United States Patent [19]

Jessen et al.

[11] Patent Number: 4,976,391

[45] Date of Patent: Dec. 11, 1990

[54] ADJUSTABLE PAPER GUIDE FOR ACOUSTIC PRINTER ENCLOSURE

[75] Inventors: Ross A. Jessen; Craig D. Drake, both of Muscatine, Iowa

[73] Assignee: Ring King Visibles, Inc., Muscatine, Iowa

[21] Appl. No.: 238,916

[22] Filed: Aug. 31, 1988

[51] Int. Cl.[5] ..... B65H 23/04; B41J 19/04; B41J 29/10

[52] U.S. Cl. ..... 226/196; 400/611; 400/613.2; 400/642

[58] Field of Search ..... 226/196, 197, 198, 199, 226/200; 400/633, 633.1, 633.2, 611, 642, 646, 613.2, 613.4; 402/80 R

[56] References Cited

U.S. PATENT DOCUMENTS

| | | | |
|---|---|---|---|
| 1,646,073 | 10/1927 | Vickers | 400/633 X |
| 1,646,271 | 10/1927 | Barney | 400/646 X |
| 4,226,410 | 10/1980 | McIntosh, Sr. et al. | 400/613.2 X |

*Primary Examiner*—John Petrakes
*Assistant Examiner*—Paul Thomas Bowen
*Attorney, Agent, or Firm*—Neuman, Williams, Anderson & Olson

[57] ABSTRACT

A paper guiding system for an acoustic printer enclosure which includes universally adjustable paper guides which slidably extend into the interior of the printer enclosure to direct printer paper across the gap formed between the paper transport system of a printer housed in the enclosure and the paper opening in a panel of the acoustic printer enclosure.

10 Claims, 1 Drawing Sheet

ADJUSTABLE PAPER GUIDE FOR ACOUSTIC PRINTER ENCLOSURE

BACKGROUND OF THE INVENTION

The present invention relates to enclosures which provide acoustic damping for printers such as those used in conjunction with personal computing equipment in the home or office, and more particularly to paper guidance systems for such acoustic printer enclosures.

Acoustic printer enclosures are designed to greatly reduce the sound levels emitted by printers to the environment. Such an acoustic enclosure generally consists of a sound absorbing enclosure which substantially completely surrounds the printer, including a shelf for mounting a printer within the enclosure. Typically, such enclosures include a thick transparent hinged cover to allow inspection of the printer and the printed material when the cover is closed and access to the printer and the printer paper when the cover is open. The interior of the acoustic printer enclosure can be lined with a sound absorbing material such as polyurethane foam. There are usually a limited number of openings in the printer enclosure, such as through its side or rear panels, for power and data cables, ventilation, and for printer paper entry and exit.

When printer paper exits, or enters and exits, a paper transport system at the rear of the printer, for example, it is necessary to provide a suitable opening in the rear panel of the acoustic enclosure to allow for paper transport through the panel. In the acoustic enclosure there is usually a gap between the rear panel of the acoustic cover and the paper transport system of the printer. This gap will vary in distance, depending on the brand and model of printer.

However, any significant gap between the paper opening in the acoustic enclosure and the printer allows the paper to sag therebetween, and paper misalignment and misfeed can result. Preferably, some sort of paper guide system is provided in an attempt to minimize the problems associated with this gap. Such guiding systems have included paper support guides of various configurations to restrict paper motion and control the paper path between the printer paper transport system and the paper opening in the acoustic enclosure.

Such paper guiding systems are sometimes formed as an integral portion of a grommet lining the paper opening in the acoustic enclosure. Slots for restricting vertical displacement of paper exiting, or entering and exiting, the paper opening can be formed by horizontal splines extending the width of the grommet. The paper support guides are often just fixed length support tongues mounted along or between the upper and/or lower edges of the grommet, or between the upper or lower grommet edges and a central spline, if such a spline is included. These support tongues can have relatively broad surfaces which support the printed paper from below, or above and below, in the gap between the paper transport system of the printer and the rear panel of the acoustic enclosure. Alternatively, C-shaped channels may be provided as the paper support guides and positioned along the edges of the paper in the gap region to align and support the printer paper. The paper support guides are often laterally adjustable along the grommet to accommodate a variety of paper widths.

The types of paper guiding system described above are not completely satisfactory. Support guides such as the fixed tongues and the edge channels described above work properly when they are of the correct length for the particular gap length between the paper opening and the printer and the correct height for the paper transport system of the printer, but the range of gap length for different printers is so wide that such guides cannot effectively be used with printers of different sizes and configurations, or must be trimmed down to size to fit a particular printer, or must be available in different lengths for different gap lengths. If the guides are trimmed to fit a particular printer, they will not work properly if a printer of a different size or configuration is used in the acoustic enclosure. It is therefore apparent that a universally adjustable paper guide arrangement is highly desirable to allow both standardization of the components of the acoustic printer enclosure and interchangeability of printers.

Consequently, one object of the present invention is to provide a universal guide system for supporting paper transported through an acoustic printer enclosure to or from the paper transport system of a printer housed within the acoustic enclosure.

Another object of the present invention is to standardize the construction of an acoustic printer enclosure with a paper guide system which accommodates a wide range of printer sizes and configurations.

Still another object of the present invention is to improve the reliability of a paper guide system for an acoustic printer enclosure.

SUMMARY OF THE INVENTION

The above described objects, as well as other advantages described herein, are secured by an acoustic printer enclosure which includes an opening to allow entry or exit of paper from the printer enclosure and laterally adjustable paper support guides disposed in the proximity of the opening and having longitudinally adjustable tongues. The longitudinal adjustment feature for the tongue guides permits a single length tongue guide to be adjusted to a wide range of gap distances between the rear panel of the acoustic enclosure and the paper transport system of a printer housed within the enclosure. Any excess length of the tongue guide simply protrudes from the exterior of the acoustic printer enclosure after adjustment and may advantageously be adjusted to guide the paper flow immediately outside the enclosure, so that no trimming is necessary. The lateral adjustment is provided by a tongue guide support base that is adapted to slide longitudinally with respect to the paper opening in the acoustic enclosure. The edges of these tongue guide support bases preferably are secured in a sliding manner on a grommet lining the paper opening. One section of the grommet is adapted to allow easy insertion and removal of the support bases. Any number of such tongue guide and support bases can be used, and they can be added or removed to accommodate different widths of paper. They can be used along the top of the paper opening to prevent paper from buckling upward, as well as along the bottom of the paper opening for supporting and guiding the paper from below.

DETAILED DESCRIPTION OF THE INVENTION

Figure 1:
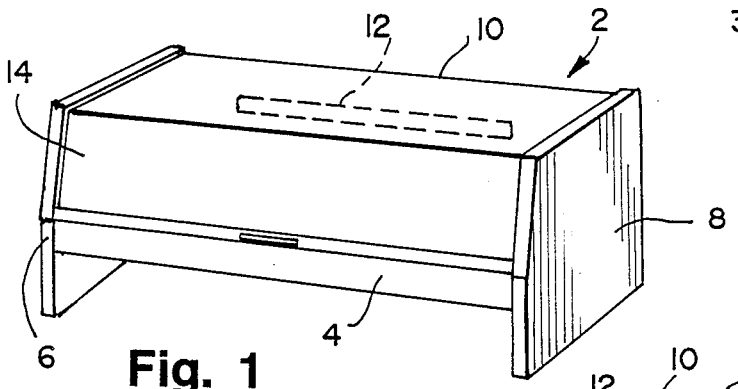
FIG. 1 is a typical acoustic printer enclosure including an opening in the rear panel to allow printer paper to enter and/or exit the enclosure.

Referring to the drawings, wherein like referenced characters refer to like or corresponding parts throughout the views, FIG. 1 shows a typical acoustic printer enclosure 2 which may incorporate a paper guiding system according to the present invention. The printer enclosure 2 includes a printer support shelf 4, a left side panel 6, a right side panel 8, a rear panel 10 including a paper opening 12 shown in broken line for permitting the entry and exit of printer paper, and a top cover 14, which may conveniently be transparent and hinged along the top edge of the rear panel 10 for ease of printer inspection and access. The acoustic enclosure 2 may be provided with sound insulating materials such as polyurethane foam on its interior surfaces, for further damping the printer noise. The acoustic enclosure 2 is large enough to accommodate most commercially available printers.

Figure 2:
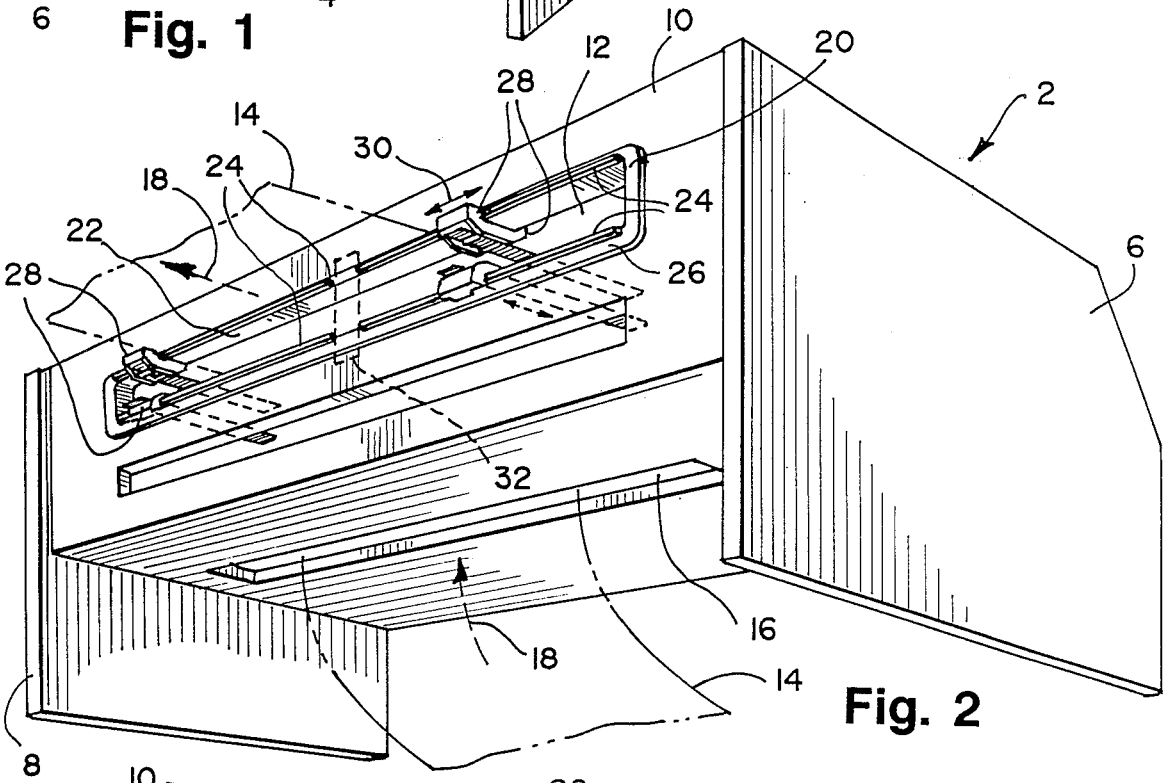
FIG. 2 is a rear perspective view of the acoustic enclosure shown in FIG. 1, including the paper guiding system according to a preferred embodiment of the present invention.

FIG. 2 is a rear perspective view of the acoustic enclosure 2, showing a paper guide system according to the present invention mounted in the paper opening 12 of the rear panel. A typical printing paper path 14 is shown in broken line. The paper path 14 extends in the direction indicated by broken arrows 18 and is shown entering the acoustic enclosure 2 from the bottom through the opening 16 in the printer support shelf 4 for a printer having a bottom feed paper transport system. The paper path 14 exits the acoustic enclosure 2 through rear panel opening 12. Alternatively, the paper path 14 can both enter and exit the paper opening 12 in the rear panel, if the printer housed in the acoustic enclosure 2 has a rear feed paper transport system instead of bottom feed.

The paper opening 12 includes a generally rectangular paper guide grommet 20 which mounts within the opening 12. The grommet 20 has upper and lower longitudinal surface sections 22 along its periphery. It includes longitudinal retaining lips or ridges 24 substantially parallel to the surface sections 22 both outside and inside the rear panel 10. The ridges 24 may be linear projections extending from a collar region 26 of the grommet 20, as the exterior ridges 24 are shown in FIG. 2, or they may be extensions of the surface sections 22, as the interior ridges 24 are shown in FIG. 4.

A pair of tongue guide and support base assemblies 28 engage and slide along the surface sections 22 of the grommet 20 in the direction indicated by arrow 30 in FIG. 2, held in place by the ridges 24. Each assembly 28 includes a support base 36 and a tongue guide 34. Each support base 36 is generally C-shaped in crosssection, with the opposed end legs of the C comprising the lower engagement portions 31. The ridges 24 may include one or more gaps along their length, such as in the region 32 shown in broken line, of a width equal to or greater than the width of the engagement portions 31 to facilitate easy insertion and removal of the tongue guide and support base assemblies 28 on the grommet 20.

Figure 3:
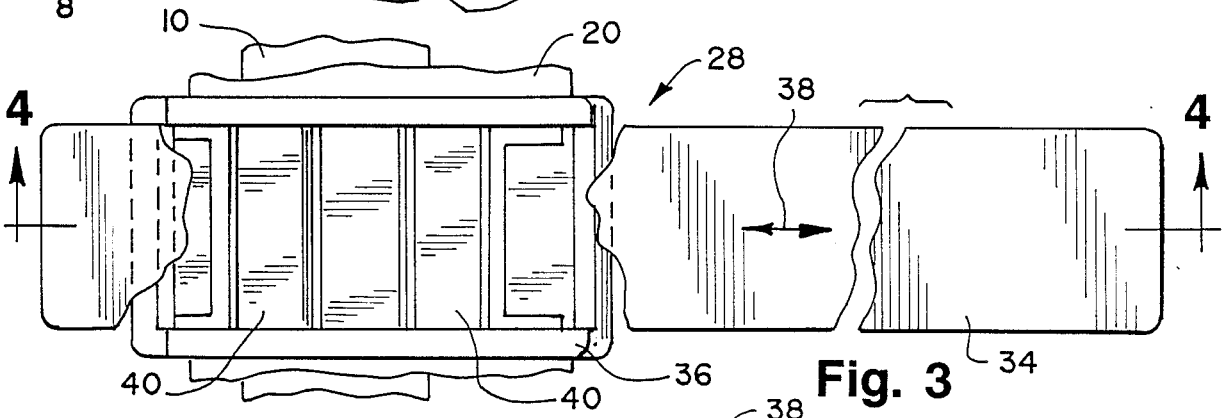
FIG. 3 is a detailed view of one of the tongue guide and support base assemblies according to the present invention.

A detailed top view of one of the tongue guide and support base assemblies 28 is shown in FIG. 3. The tongue guide 34 is slidably retained in the support base 36. The tongue guide 34 slides in the support base 36 in the direction indicated by arrow 38. The support base 36 is shown mounted on the grommet 20 in the rear panel 10. It is apparent that sliding the tongue guide 34 longitudinally of the support base, in the direction indicated by the arrow 38, allows an adjustable amount of the tongue guide 34 to protrude into the interior of the acoustic enclosure 2. The interior protrusion of the tongue guide 34 may thereby be adjusted to substantially span the gap between the rear panel 10 and the paper transport system of a printer housed within the acoustic enclosure 2. After adjustment, a portion of the tongue guide 34 may extend beyond the support base 36 outside of the acoustic enclosure 2, but this extension does not interfere with paper transport and in fact may advantageously be bent or otherwise used to direct and/or support the flow of paper immediately outside the acoustic enclosure 2.

Figure 5:
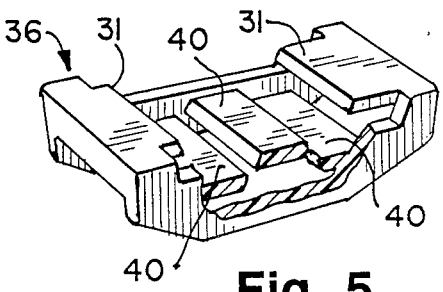
FIG. 5 is a detailed view of the support base for the tongue guide and support base assembly shown in FIGS. 3 and 4.
Figure 4:
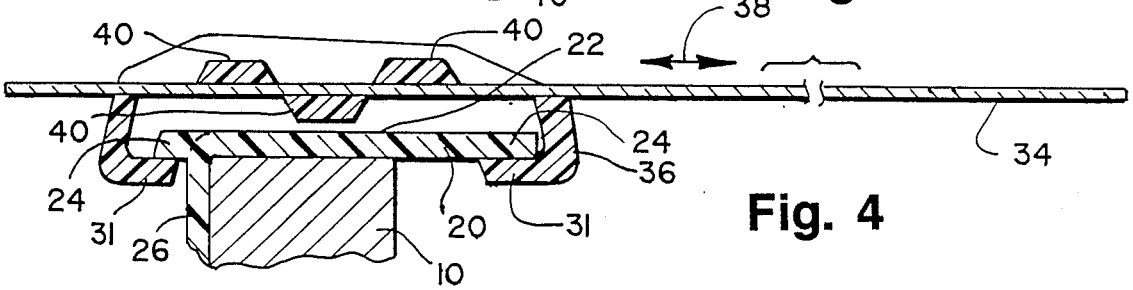
FIG. 4 is a cross sectional view of the tongue guide and support base assembly shown in FIG. 3 along line 4—4.

Although the design of the support base 36 can be such that the tongue guide 34 slides within continuous surfaces of a channel formed within the support base 36, the tongue guide 34 is shown to be slidably retained by oppositely facing transverse splines 40, see FIGS. 3 and 4. These splines may have a polygonal cross-section as shown, or any other shape, such as cylindrical, and may be changed in thickness, contour, width and number to achieve any desired degree of slidability. A cut away view of the support base 36 is shown in FIG. 5, which illustrates how the splines 40 are arranged in a staggered relationship in a preferred embodiment to slidably retain the tongue guide 34 between them. The illustrated splines 40 have opposing surfaces in planes vertically spaced from one another, with the individual splines offset laterally in staggered relation to one another.

Although shown as substantially straight in FIG. 3, the tongue guide 34 may include a longitudinal arc of curvature or some other shape to provide a greater freedom of movement for paper within the acoustic enclosure 2 or to guide the printer paper to a different height within the acoustic enclosure 2. The tongue guide 34 preferably is formed of a metal that may be bent by a user to more precisely direct printer paper to or from the paper transport system of the printer. The tongue guide 34, the support base 36 and the grommet 20 may be fabricated of any convenient material, although aluminum is preferred for the tongue guide for its durability and ability to be bent repeatedly, and a plastic material is preferred for the support base 36 and the grommet 20 to permit fabrication by molding.

The paper guide system described above does not unnecessarily and/or rigidly restrict paper motion, as conventional fixed paper guides or paper edge channels, but rather supports and directs paper travel between the paper transport system of a printer housed in the acoustic enclosure 2 and the rear panel of the acoustic printer enclosure 2. The tongue guide and support base assemblies 28 may be inserted both above the paper path and below it, to prevent upward buckling as well as sagging of the printer paper. Because of the minimal paper path restriction and flexibility offered by this paper guiding system, the printer paper may be fed and retrieved through the same paper opening 12 with excellent results, when a printer with rear paper feed is installed in the acoustic enclosure 2. The number of paper guides in an assembly may be varied as desirable to adequately support and direct the paper to be used.

There has been described above a paper guiding system for acoustic printer enclosures which combines minimal paper path restriction, universal adjustability, and compatability with both bottom and rear paper feed printers. It will be understood that various changes in the details, arrangements and configurations of the parts which have been herein described and illustrated in order to explain the nature of the invention may be made by those skilled in the art within the principle and scope of the invention as expressed in the appended claims.

What is claimed is:

1. An adjustable paper guide system for transporting paper through an enclosure panel, comprising:

a grommet for mounting in an opening in said enclosure panel for transporting paper therethrough, said grommet including a peripheral surface with substantially longitudinal surface sections and retaining ridges extending outward along each of said longitudinal surface section;

at least one support base slidably mounted to said longitudinal surface sections and over said retaining ridges with a freedom of movement along a sliding axis substantially parallel to the length of said longitudinal surface sections, having a channel extending through each said support base transverse to said sliding axis of said support base; and a tongue guide slidably mounted to said support base through said channel for guiding paper through said grommet, each tongue guide having a sliding axis substantially transverse to said sliding axis of said support base on said grommet.

2. The paper guide system recited in claim 1, wherein said support base channel is formed by a plurality of transverse splines extending across said support base.

3. The paper guide recited in claim 2, wherein said transverse splines are alternately arranged on opposite sides of the channel.

4. The paper guide system recited in claim 3, wherein said transverse splines have a polygonal cross section.

5. An adjustable paper guide system for transporting paper through an enclosure panel, comprising:

a grommet for mounting in an opening in said enclosure panel for transporting paper therethrough, said grommet including a peripheral surface with substantially longitudinal surface sections and retaining ridges extending outward along each of said longitudinal surface sections, with at least one of said retaining ridges comprising a linear projection extending from a collar region of said grommet;

at least one support base slidably mounted to said longitudinal surface sections and over said retaining ridges with a freedom of movement along a sliding axis substantially parallel to the length of said longitudinal surface sections, having a channel extending through each said support base transverse to said sliding axis of said support base; and a tongue guide slidably mounted to said support base through said channel for guiding paper through said grommet, each tongue guide having a sliding axis substantially transverse to said sliding axis of said support base on said grommet.

6. The paper guide system recited in claim 5, wherein said linear projection includes a gap along a portion of said collar region for attaching and removing said support base.

7. An adjustable paper guide system for transporting paper through an enclosure panel, comprising:

a grommet for mounting in an opening in said enclosure panel for transporting paper therethrough, said grommet including a peripheral surface with substantially longitudinal surface sections and retaining ridges extending outward along each of said longitudinal surface sections, with at least one of said retaining ridges comprising an extended surface region of one of said longitudinal surface sections;

at least one support base slidably mounted to said longitudinal surface sections and over said retaining ridges with a freedom of movement along a sliding axis substantially parallel to the length of said longitudinal surface sections, having a channel extending through each said support base transverse to said sliding axis of said support base; and a tongue guide slidably mounted to said support base through said channel for guiding paper through said grommet, each tongue guide having a sliding axis substantially transverse to said sliding axis of said support base on said grommet.

8. The paper guide system recited in claim 7, wherein said extended surface region includes a gap along a portion of said corresponding longitudinal surface section for attaching and removing said support base.

9. An adjustable paper guide system for transporting paper through an enclosure panel, comprising:

a grommet for mounting in an opening in said enclosure panel for transporting paper therethrough, said grommet including a peripheral surface with substantially longitudinal surface sections and retaining ridges extending outward along each of said longitudinal surface sections;

at least one support base slidably mounted to said longitudinal surface sections and over said retaining ridges with a freedom of movement along a sliding axis substantially parallel to the length of said longitudinal surface sections, having a channel extending through each said support base transverse to said sliding axis of said support base; and a bendable tongue guide slidably mounted to said support base through said channel for guiding paper through said grommet, each tongue guide having a sliding axis substantially transverse to said sliding axis of said support base on said grommet.

10. In an acoustic printer enclosure defining an elongated slot through which printer paper may enter and/or exit, a paper guide system comprising:

guide means mounted with respect to the elongated slot so as to guide printer paper entering and/or exiting said enclosure through said elongated slot and means supporting the guide means for selective positioning of said guide means in the direction defined by the major dimension of said elongated slot, said guide means including a portion that is variably extendable into the acoustic printer enclosure from said slot.

* * * * *